United States Patent [19]

Kasai

[11] Patent Number: 4,987,661

[45] Date of Patent: Jan. 29, 1991

[54] SNAP BUCKLE

[75] Inventor: Kazumi Kasai, Namerikawa, Japan

[73] Assignee: Yoshida Kogyo K.K., Tokyo, Japan

[21] Appl. No.: 521,422

[22] Filed: May 10, 1990

[30] Foreign Application Priority Data

May 13, 1989 [JP] Japan ..... 1-54696[U]

[51] Int. Cl.[5] ..... A44B 11/25

[52] U.S. Cl. ..... 24/625; 24/633; 24/644

[58] Field of Search ..... 24/625, 633, 664, 613, 24/614, 615, 616, 618

[56] References Cited

U.S. PATENT DOCUMENTS 1,737,246 11/1929 Jones ..... 24/625
4,150,464 4/1979 Tracy ..... 24/615
4,672,725 6/1987 Kasai ..... 24/625

FOREIGN PATENT DOCUMENTS 59-31908 2/1984 Japan .
61-202212 12/1986 Japan .

*Primary Examiner*—Victor N. Sakaran
*Attorney, Agent, or Firm*—Hill, Van Santen, Steadman & Simpson

[57] ABSTRACT

A buckle comprising a male member and a female member releasably engageable therewith, the female member including a pair of resilient arms serving as a release lever and a pair of inwardly directed flanges. The resilient arms each have a stop finger normally spaced apart from but abuttingly engageable with the flange when lateral pull is exerted upon the release lever.

3 Claims, 2 Drawing Sheets

SNAP BUCKLE

BACKGROUND OF THE INVENTION

1. Field of the Invention

This invention relates to a buckle for releasably connecting loose ends of a belt, strap and other elongate fastening devices applied to trousers, skirts, bags and like garment articles.

2. Prior Art

There have been proposed numerous buckles of the character mentioned. Some were easy to use but structurally vulnerable. Design considerations have therefore been directed toward strengthening the buckle body, particularly a release lever portion thereof, which is susceptible to damage by the influence of external stresses.

Japanese Utility Model Laid-Open Publication No. 59-31908 discloses a buckle (FIG. 5) comprising a male member 100 and a female member 101 releasably engageable therewith in a manner well known in the art, the female member 101 having a pair of release levers 102 to be manipulated to resiliently couple and uncouple the male and female members 100 and 101, each of which release lever has a prong 103 projecting longitudinally of the buckle body, and the female member 101 further having on opposite sides thereof a pair of shielding lugs 104 projecting longitudinally toward the release levers 102 and abuttingly engageable with the prongs 103 to restrict excessive outward displacement of the release levers 102 when lateral stresses are applied. This prior art device advantageously protects the release lever 102 against possible damage resulting from lateral stresses tending to pull the levers 102 laterally outwardly. However, since the release levers 102 are exposed outwardly beyond the female member 101, they are vulnerable against external forces exerted in a direction substantially perpendicular to the general plane of the buckle, or from either surface of the buckle.

Another prior buckle device (FIGS. 6 and 7) is disclosed in Japanese Utility Model Laid-Open Publication No. 61-202212 in which a female member 200 has embraced therein a substantial portion of each of a pair of release levers 201, each of which has a downwardly projecting lug 202 lockable in a slot 203 formed in the bottom wall of the female member 200 This arrangement appears to overcome the problem of the release lever associated with external stresses applied in a direction both perpendicular to and parallel with the general plane of the buckle. However, the lugs 202 would be susceptible to deformation in contact with the peripheral walls of the slots 203 or liable to spin out of the slot 203 when the buckle was subjected to increased stresses, eventually leading to failure or damage of the release levers 201. This would be more likely with relatively thin, small-sized buckles.

SUMMARY OF THE INVENTION

With foregoing drawbacks of the prior art in view, the present invention seeks to provide an improved buckle which incorporates such structural features which will effectively hold its release levers harmless against external forces exerted in a direction both perpendicular to and parallel with the general place of the buckle.

This and other objects and features of the invention will become apparent from reading the following detailed description with reference to the accompanying drawings which illustrate by way of example a preferred embodiment.

According to the invention, there is provided a buckle comprising a male member having a pair of resilient legs and a female member having a pair of sub-chambers for receiving the respective resilient legs, the female member including a casing formed by an upper plate and a lower plate disposed in spaced parallel relationship and defining therebetween the sub-chambers, the upper and lower plates respectively having inwardly directed flanges, and a pair of resilient arms respectively having inwardly directed neck portions movable between the flanges, and a stop finger normally spaced apart from but engageable with one of the flanges when lateral stresses are exerted upon the resilient arms.

DETAILED DESCRIPTION OF THE INVENTION

Figure 1:
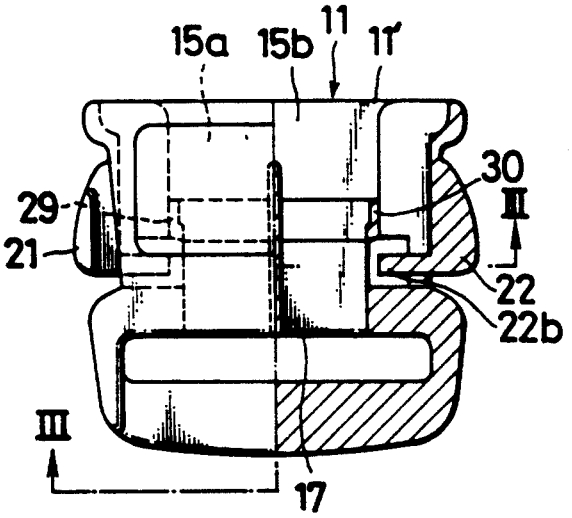
FIG. 1 is a plan, partly sectional, view of a female or socket member constituting one part of a buckle provided in accordance with the invention.
Figure 2:
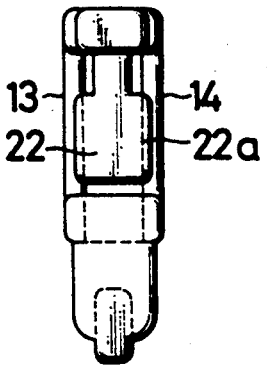
FIG. 2 is a side elevational view of the female member shown in FIG. 1.
Figure 4:
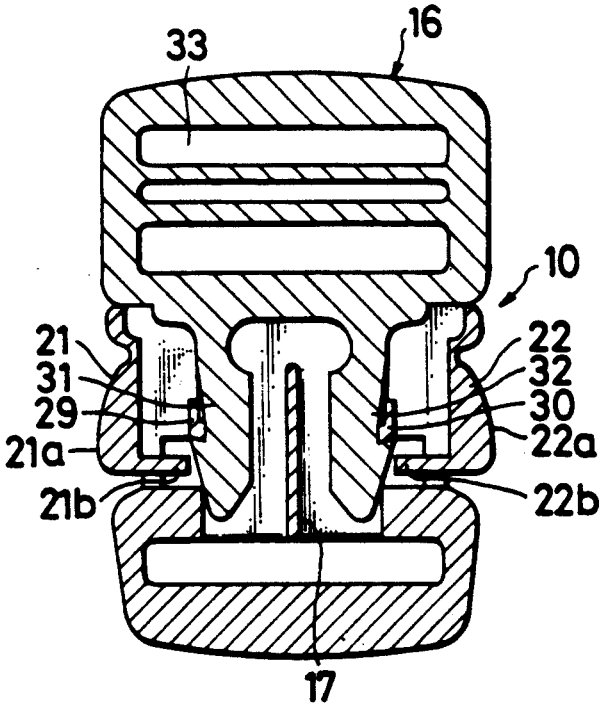
FIG. 4 is a longitudinal cross-sectional view of the female member of FIG. 1 shown coupled with a male or plug member constituting another part of the buckle.
Figure 5:
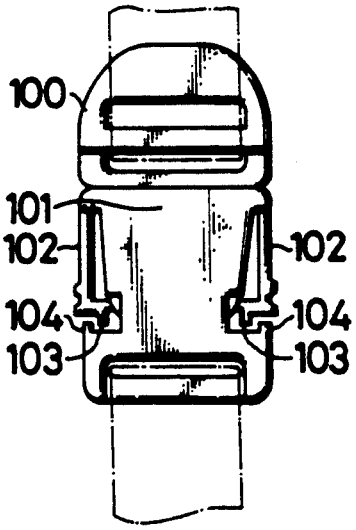
FIG. 5 PRIOR ART
FIG. 5 is a plan view of one prior art buckle.
Figure 6:
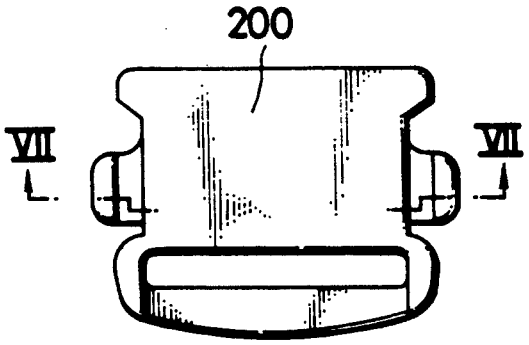
FIG. 6 PRIOR ART
FIG. 6 is a plan view of another prior art.
Figure 7:
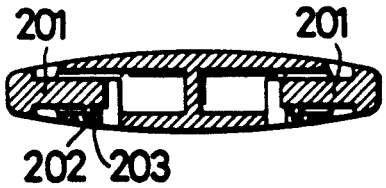
FIG. 7 PRIOR ART
FIG. 7 is a transverse cross-sectional view taken on the line VII—VII of FIG. 6.

Referring now to the drawings and FIG. 1 in particular, there is shown a female or socket member 11 constituting one part of a buckle 10 embodying the invention which is molded into a polygonal structure from a suitable synthetic resin such as polyacetal, nylon and polypropylene. The female member 10 comprises a body 11' including a casing 12 generally rectangular in shape which is formed by a pair of upper plate and lower plates 13, 14 disposed in spaced parallel relationship and defining therebetween a chamber 15 for receiving a male or plug member 16 (FIG. 4). The upper and lower plates 13, 14 are centrally joined together by a vertical partition wall 17 which divides the chamber 15 into two identical sub-chambers **15*a* and 15*b*. The casing 12 has an opening 18 in opposite sides thereof disposed remote from the partition wall 17 in communication with each of the subchambers 15*a*, 15*b* and defined by inwardly directed upper and lower flanges 19, 20 which extend from the upper and lower plates 13, 14, respectively and which have respective end surfaces 19*a*, 20*a*** in confronting relation to each other.

Figure 3:
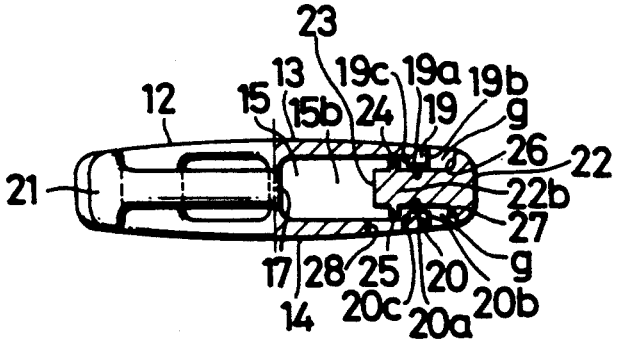
FIG. 3 is a transverse cross-sectional view taken on the line III—III of FIG. 1.

A pair of resilient arms 21, 22 extend integrally from opposite sides of the body 11' of the female member 11 and are elastically deformable to serve as a release lever to releasably hold the male member 16 in place within the chamber 15 in a manner hereinafter to be described. The resilient arms 21 and 22 each have an outwardly bulged portion **21*a*, (22*a*) to be gripped by hand in manipulating the release lever and an inwardly directed neck portion 21*b*, (22*b*) having adjacent to a distal free end 23 a pair of upper and lower stop fingers 24 and 25 respectively projecting upwardly and downwardly within the chamber 15 beyond the respective end surfaces 19***a*, 20*a* of the flanges 19, 20 as better shown in FIG. 3. The neck portion 21*b*, (22*b*) is reduced in thickness to be able to move through the opening 18 between the upper and lower flanges 19, 20 and merge at the opposite end (remote from the distal end 23) with upper and lower shoulder portions 26, 27 which normally (when the buckle is not in use) define, with an outer lateral side wall 19*b*, (20*b*) of the flange 19, (20), a gap g of a predetermined width governing the inward flexing movement of the release lever (resilient arms 21, 22). In such normal position of the resilient arms 21, 22, the stop fingers 24, 25 are held apart from respective inner side wall 19*c*, 20*c* of the flanges 19, 20. However, when lateral stresses are applied to pull the resilient arms 21, 22 (release lever) laterally outwardly, the stop fingers 24, 25 come into abutting engagement with the respective inner side walls 19*c*, 20*c* of the flanges 19, 20 to absorb thereat the lateral stresses so as to prevent detachment of the resilient arms 21, 22 from the body 11'.

An aperture 28 is formed in the lower plate 14 of the casing 12 for receiving therein the lower stop finger 25 when the resilient arms 21, 22 are held in the normal position, for which purpose the lower stop finger 25 may conveniently be slightly longer than the upper stop finger 24.

Designated at 29 and 30 are a pair of guide rails spaced apart from each other across the partition wall 17 and respectively defining with the partition wall 17 the sub-chambers 15*a* and 15*b* for the passage and reception therethrough of a pair of resilient legs 31 and 32 of the male member 16 constituting another part of the buckle 10. The male member 16 is conventional with apertures 33 for the insertion of a loose end of a belt or the like.

When coupling the male member 16 with the female member 11, this is done by inserting the legs 31, 32 through the sub-chambers 15*a*, 15*b* respectively until the legs 31, 32 are brought into hooked engagement with the respective guide rails 29, 30 in a well known manner as shown in FIG. 4. When separating the male member 16 from the female member 11, this is done by depressing the resilient arms 21, 22 at the bulged portions 21*a*, 22*a* inwardly toward each other so as to release the legs 31, 32 by elastic deformation from the guide rails 29, 30 also in a well known manner.

Obviously, various modifications and variations of the present invention are possible in the light of the above teaching. It is therefore to be understood that within the scope of the appended claims the invention may be practiced otherwise than as specifically described.

What is claimed is:

1. A buckle comprising a male member having a pair of resilient legs and a female member having a pair of sub-chambers for receiving said resilient legs respectively, said female member including:

(a) a casing formed by an upper plate and a lower plate disposed in spaced parallel relationship and defining therebetween said sub-chambers, said upper and lower plates respectively having inwardly directed flanges, and (b) a pair of resilient arms respectively having inwardly directed neck portions movable between said flanges, and a stop finger normally spaced apart from but engageable with one of said flanges when lateral stresses are exerted upon said resilient arms.

2. A buckle according to claim 1 further including a pair of stop fingers respectively projecting upwardly and downwardly from said neck portions and normally spaced apart from but engageable with said flanges respectively, when lateral stresses are exerted upon said resilient arms.

3. A buckle according to claim 1 further including an aperture in one of said plates for normally receiving therein one of said stop fingers.

* * * * *